US011587755B2

(12) United States Patent
Chen

(10) Patent No.: US 11,587,755 B2
(45) Date of Patent: Feb. 21, 2023

(54) POWER SWITCH WITH INDEPENDENT LIGHT-EMITTING CHAMBER

(71) Applicant: GOLDWEAL FAR EAST LTD., Dongguan (CN)

(72) Inventor: Tsan-Chi Chen, New Taipei (TW)

(73) Assignee: GOLDWEAL FAR EAST LTD., Dongguan (CN)

( * ) Notice: Subject to any disclaimer, the term of this patent is extended or adjusted under 35 U.S.C. 154(b) by 157 days.

(21) Appl. No.: 17/146,420

(22) Filed: Jan. 11, 2021

(65) Prior Publication Data

US 2022/0139657 A1 May 5, 2022

(30) Foreign Application Priority Data

Nov. 4, 2020 (TW) ..... 109138482

(51) Int. Cl.
*H01H 23/02* (2006.01)
*H01H 73/26* (2006.01)

(52) U.S. Cl.
CPC ..... *H01H 73/26* (2013.01); *H01H 23/025* (2013.01)

(58) Field of Classification Search
CPC ..... H01H 13/83; H01H 2219/062; H01H 2219/039; H01H 13/023; H01H 2219/06; H01H 2221/07; H01H 9/181; H01H 2219/036; H01H 2219/044; H01H 2013/026; H01H 9/16; H01H 2219/0622; H01H 2219/037; H01H 23/143; H01H 23/30; H01H 23/025; H01H 2300/03; H01H 23/145; H01H 2221/016; H01H 23/14; H01H 23/04; H01H 23/168; H01H 2221/018; H01H 23/02; H01H 23/12; H01H 23/003; H01H 23/146; H01H 23/16; H01H 23/20; H01H 23/28; H01H 23/00; H01H 23/148; H01H 23/24; H01H 23/26

See application file for complete search history.

(56) References Cited

U.S. PATENT DOCUMENTS

2013/0112540 A1* 5/2013 Chen ..... H01H 23/025 200/553

FOREIGN PATENT DOCUMENTS

| | | | | |
|---|---|---|---|---|
| CN | 202405203 U | | 8/2012 | |
| CN | 203552980 | * | 4/2014 | ..... H01H 19/16 |
| CN | 203552980 U | | 4/2014 | |

(Continued)

*Primary Examiner* — Ahmed M Saeed
(74) *Attorney, Agent, or Firm* — CIPO IP Group

(57) ABSTRACT

A power switch with an independent light-emitting chamber includes a housing, a press-key, a power assembly, at least one light-emitting unit, and a circuit board. The housing is provided therein with a partition wall that divides the interior of the housing into a first receiving space and a second receiving space. The press-key and the power assembly can be disposed in the first receiving space. The press-key can bring the power assembly into a power-off state or a power-on state. The light-emitting unit can be disposed in the second receiving space and thereby turn the second receiving space into an independent light-emitting chamber. The circuit board can be disposed in the housing and electrically connected to the power assembly and the light-emitting unit. The power switch is enhanced in safety as the partition wall keeps the light-emitting unit and the power assembly from each other and hence from short-circuiting.

9 Claims, 6 Drawing Sheets

(56) References Cited

FOREIGN PATENT DOCUMENTS

| | | | |
|---|---|---|---|
| CN | 204303634 | U | 4/2015 |
| WO | 9965046 | A1 | 12/1999 |

* cited by examiner

POWER SWITCH WITH INDEPENDENT LIGHT-EMITTING CHAMBER

CROSS-REFERENCE TO RELATED PATENT APPLICATION

This non-provisional application claims priority to and the benefit of, under 35 U.S.C. § 119(a), Taiwan Patent Application No. 109138482, filed in Taiwan on Nov. 4, 2020. The entire content of the above identified application is incorporated herein by reference.

FIELD

The present disclosure relates to a power switch, and more particularly to a power switch that has an independent light-emitting chamber and whose light-emitting unit is therefore kept from short-circuiting.

BACKGROUND

The emergence of various kinds of electrical equipment has formed a closer and closer bond between people's daily lives and such equipment. Generally, a power switch is used to control the electric current running through the electric device in order to turn on and off an electric device with ease to bring the electric device into a state in which electric current is allowed to flow to and power the electric device or a state in which electric current is cut off from the electric device. To increase the safety of use, a power switch may be provided therein with a trip element. The trip element automatically trips in response to an overcurrent and thereby cuts off the supply of electric current to ensure the user's safe use of electricity.

A conventional power switch is briefly described as follows. Referring to FIG. 1, the power switch 1 includes a housing 11, a press-key 12, a first electrically conductive plate 131, a second electrically conductive plate 132, a metal plate 14, a C-shaped spring plate 15, a third electrically conductive plate 133, and a light-emitting unit 16. The housing 11 is provided therein with a receiving space 111. The top side of the housing 11 is provided with an opening 112 that is in communication with the receiving space 111. The press-key 12 is pivotally arranged at the inner edge of the opening 112. The bottom side of the press-key 12 is provided with a first pushing portion 121 adjacent to one end of the press-key 12, and a second pushing portion 122 adjacent to the other end of the press-key 12. The pushing portions 121 and 122 are configured to extend into the receiving space 111.

Referring again to FIG. 1, the first electrically conductive plate 131 is fixedly provided at the housing 11 and is adjacent to a lateral side of the housing 11. The top end of the first electrically conductive plate 1311 is located in the receiving space 111 and is provided with a first contact point P1. The bottom end of the first electrically conductive plate 131 can extend out of the housing 11. The second electrically conductive plate 132 is also fixedly provided at the housing 11. The top end of the second electrically conductive plate 132 can be located in the receiving space 111 while the bottom end of the second electrically conductive plate 132 can extend out of the housing 11. The metal plate 14 has one end fixed at the top end of the second electrically conductive plate 132 and has a free end extending toward the side where the first electrically conductive plate 131 lies. Referring to FIG. 1, the metal plate 14 is formed with a generally U-shaped groove so as to form an elastic plate 142. The free end of the elastic plate 142 extends toward the second electrically conductive plate 132 and can be displaced to the top side or the bottom side of the groove when the free end of the metal plate 14 is or is not subjected to an applied force respectively. The elastic plate 142 is provided with a second contact point P2 adjacent to the free end of the elastic plate 142. The second contact point P2 corresponds to the first contact point P1 in position.

With continued reference to FIG. 1, the C-shaped spring plate 15 has one end that can be engagingly connected to the free end of the elastic plate 142 and the other end engagingly connected to the end of the metal plate 14 that is connected to the second electrically conductive plate 132. The C-shaped spring plate 15 corresponds to the first pushing portion 121 in position. When the first pushing portion 121 is displaced downward, the C-shaped spring plate 15 can be pushed by the first pushing portion 121 and in turn drive the free end of the elastic plate 142 downward to form an electrical connection between the second contact point P2 and the first contact point P1. When the second pushing portion 122 is displaced downward, the free end of the metal plate 14 can be pushed by the second pushing portion 122 and hence displaced downward, generating an elastic restoring force that makes the free end of the elastic plate 142 spring upward; as a result, the first contact point P1 and the second contact point P2 are separated from each other. The third electrically conductive plate 133 is fixedly provided at the housing 11 and is adjacent to another lateral side of the housing 11. The top end of the third electrically conductive plate 133 can be located in the receiving space 111 while the bottom end of the third electrically conductive plate 133 extends out of the housing 11. The light-emitting unit 16 is located in the receiving space 111 and lies under the press-key 12. The two electrode leads 161 of the light-emitting unit 16 can be electrically connected to the second electrically conductive plate 132 and the third electrically conductive plate 133 respectively. The light-emitting unit 16 is supplied with electricity and emits light when the first contact point P1 and the second contact point P2 are electrically connected.

In practical use, however, the power switch 1 still has its issues. Referring again to FIG. 1, the power switch 1 generally has a compact design with a small volume such that the space inside the housing 11 is rather limited. To save space, the electrode leads 161 of the light-emitting unit 16 are usually bent as shown in FIG. 1. If an assembly worker inadvertently bends the electrode leads 161 to an excessive degree and brings the electrode leads 161 into contact with the C-shaped spring plate 15, a short circuit will be formed. It follows that a lot of time and effort are required for adjusting the electrode leads 161 during the assembly process, e.g., by pulling the electrode leads 161 laterally apart to avoid contact with the C-shaped spring plate 15. The additional adjustment not only hinders the assembly process from being automated, but also lowers the yield of the power switch 1.

Moreover, when the press-key 12 is pressed multiple times in a back-and-forth manner, the light-emitting unit 16 tends to he shaken slightly as a result. If the shaking takes place repeatedly over a long time, the electrode leads 161 may be brought closer to, and eventually form a short circuit with, the C-shaped spring plate 15, which is dangerous. Accordingly, how to resolve the foregoing issues effectively and provide the public with a safer product is one of the important issues to be addressed by the present disclosure.

SUMMARY

In view of the technical issues of the conventional power switches, and to solve the aforesaid issues effectively, as the result of extensive research and experiment, the present disclosure provides a power switch with an independent light-emitting chamber.

One aspect of the present disclosure is directed to a power switch having an independent light-emitting chamber. The power switch includes a housing, a press-key, a power assembly, at least one light-emitting unit and a circuit board. The housing is provided therein with a partition wall that divides an interior of the housing into a first receiving space and a second receiving space that is an independent light-emitting chamber. The top side of the housing is provided with a first opening corresponding to the first receiving space and a second opening corresponding to the second receiving space. The press-key has a middle portion that can be pivotally connected to an inner edge of the first opening or a position at the first opening that is adjacent to the inner edge of the first opening. A first pushing portion is protrudingly provided at a position on the press-key that is adjacent to one end of a bottom side of the press-key, and a second pushing portion is protrudingly provided at a position on the press-key that is adjacent to the other end of the bottom side of the press-key. The power assembly can be disposed in the first receiving space and has a first contact point and a second contact point. The power assembly can separate the second contact point from the first contact point when the first pushing portion moves downwards, and can electrically connect the second contact point with the first contact point when the second pushing portion moves downwards. The at least one light-emitting unit can be disposed in the second receiving space. The circuit board can be disposed in the housing and electrically connected to the power assembly and the light-emitting unit. As the light-emitting unit and the power assembly are kept from each other by the partition wall, short-circuiting between the light-emitting unit and the power assembly is effectively prevented.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION

Figure 1:
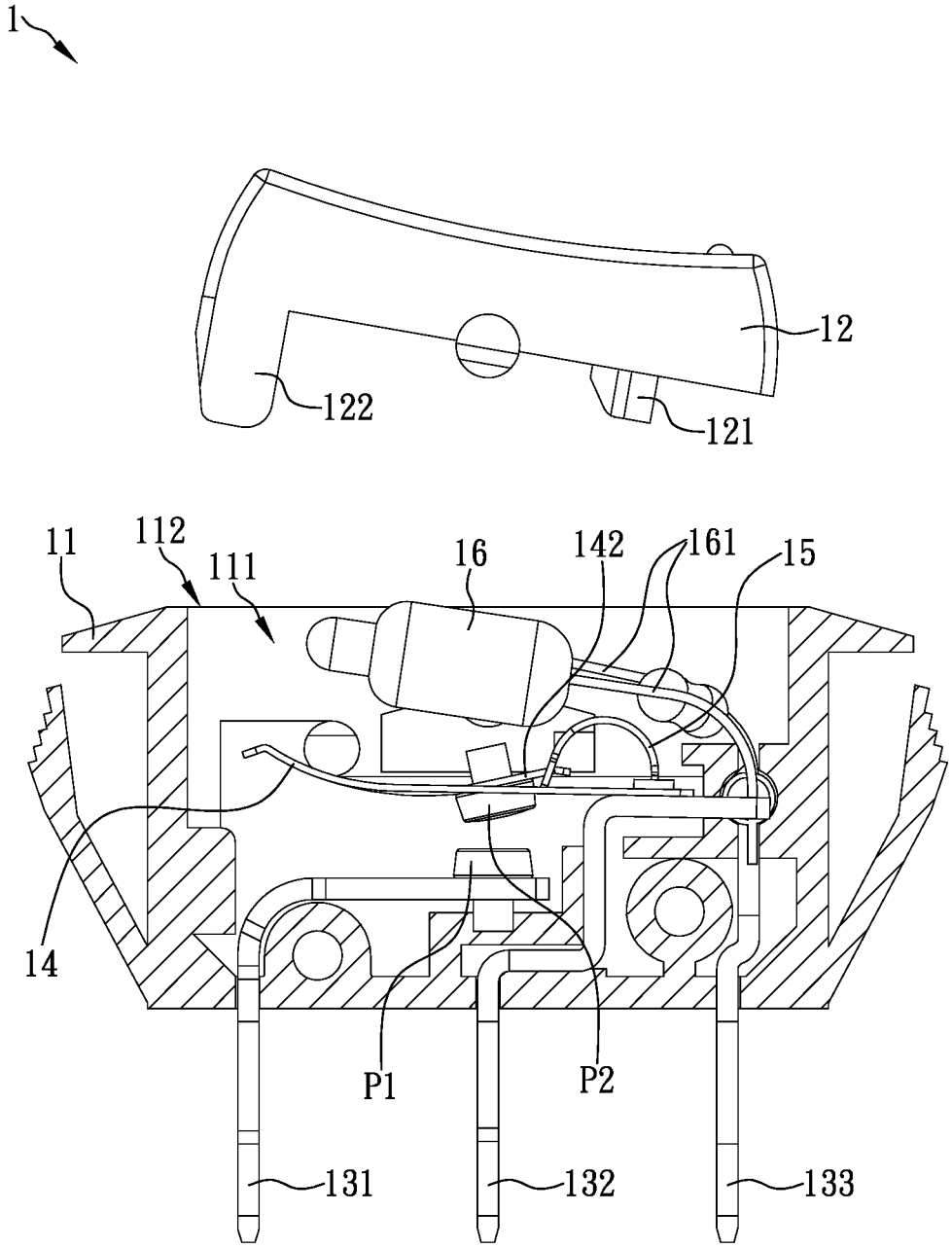
FIG. 1(Prior Art)
FIG. 1 is a sectional view of a conventional power switch.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The accompanying drawings are schematic diagrams and may not have been drawn to scale. Numbering terms such as "first", "second" or "third" can be used to describe various components, materials, objects, or the like, which are for distinguishing one component/material/object from another one only, and are not intended to, nor should be construed to impose any substantive limitations on the components, materials, objects, or the like. Directional terms (e.g., "upper/top" and "lower/bottom") are explanatory only and are not intended to be restrictive of the scope of the present disclosure.

Figure 2:
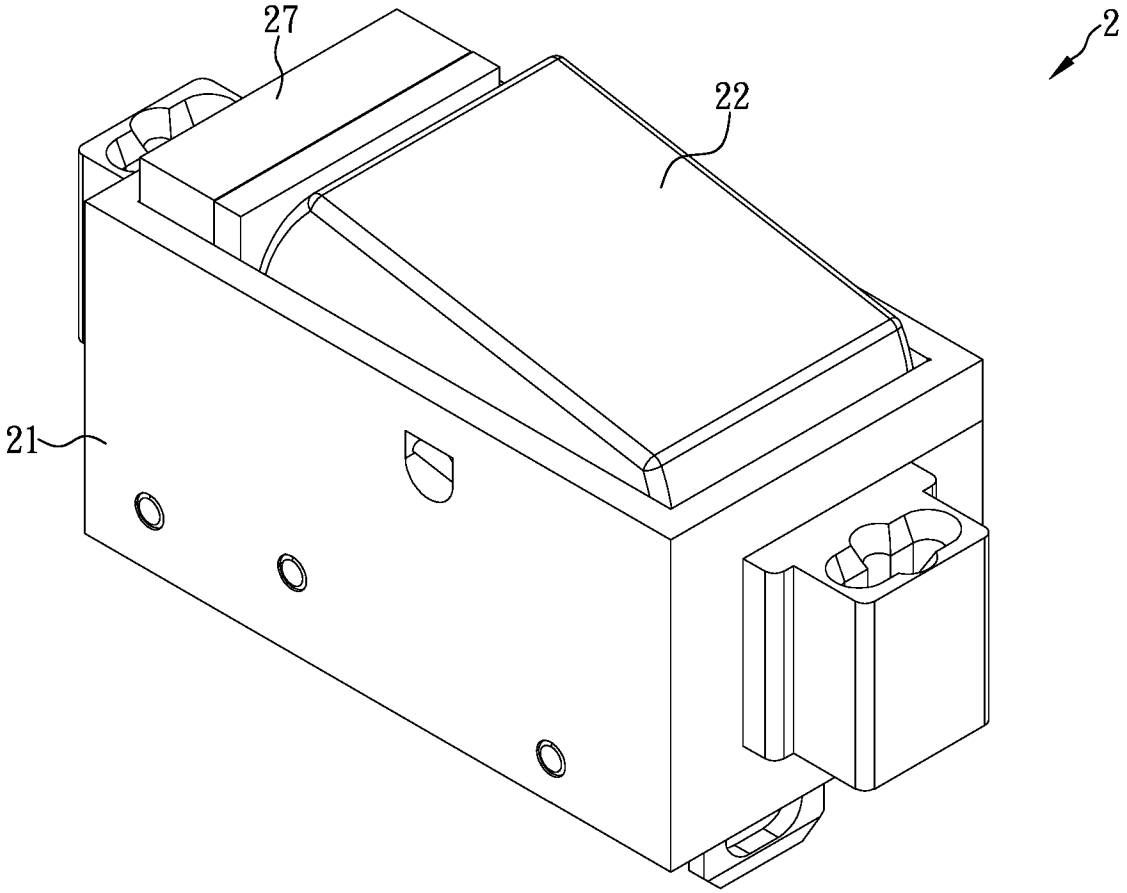
FIG. 2 is a perspective view of a power switch according to certain embodiments of the present disclosure.
Figure 3:
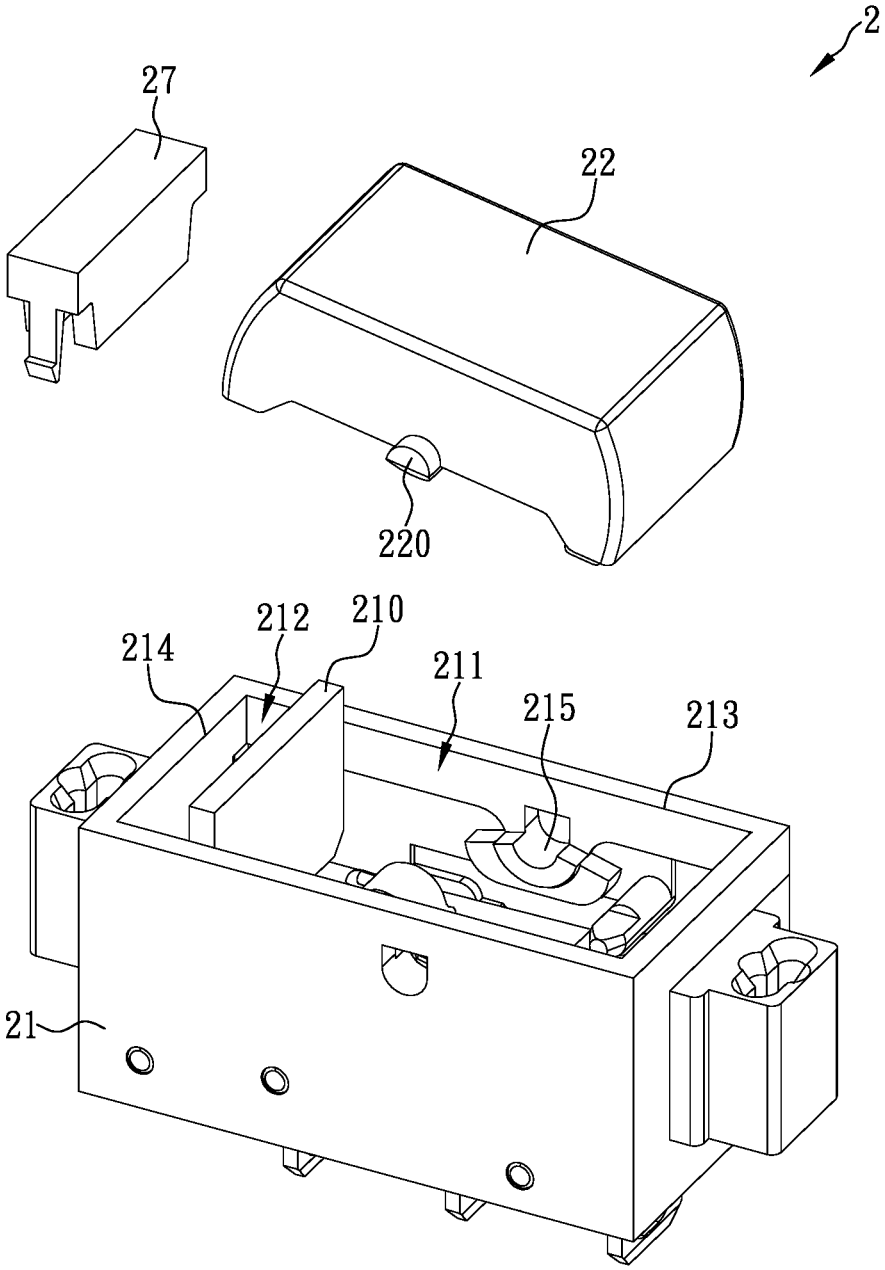
FIG. 3 is an exploded perspective view of the power switch according to certain embodiments of the present disclosure.
Figure 4:
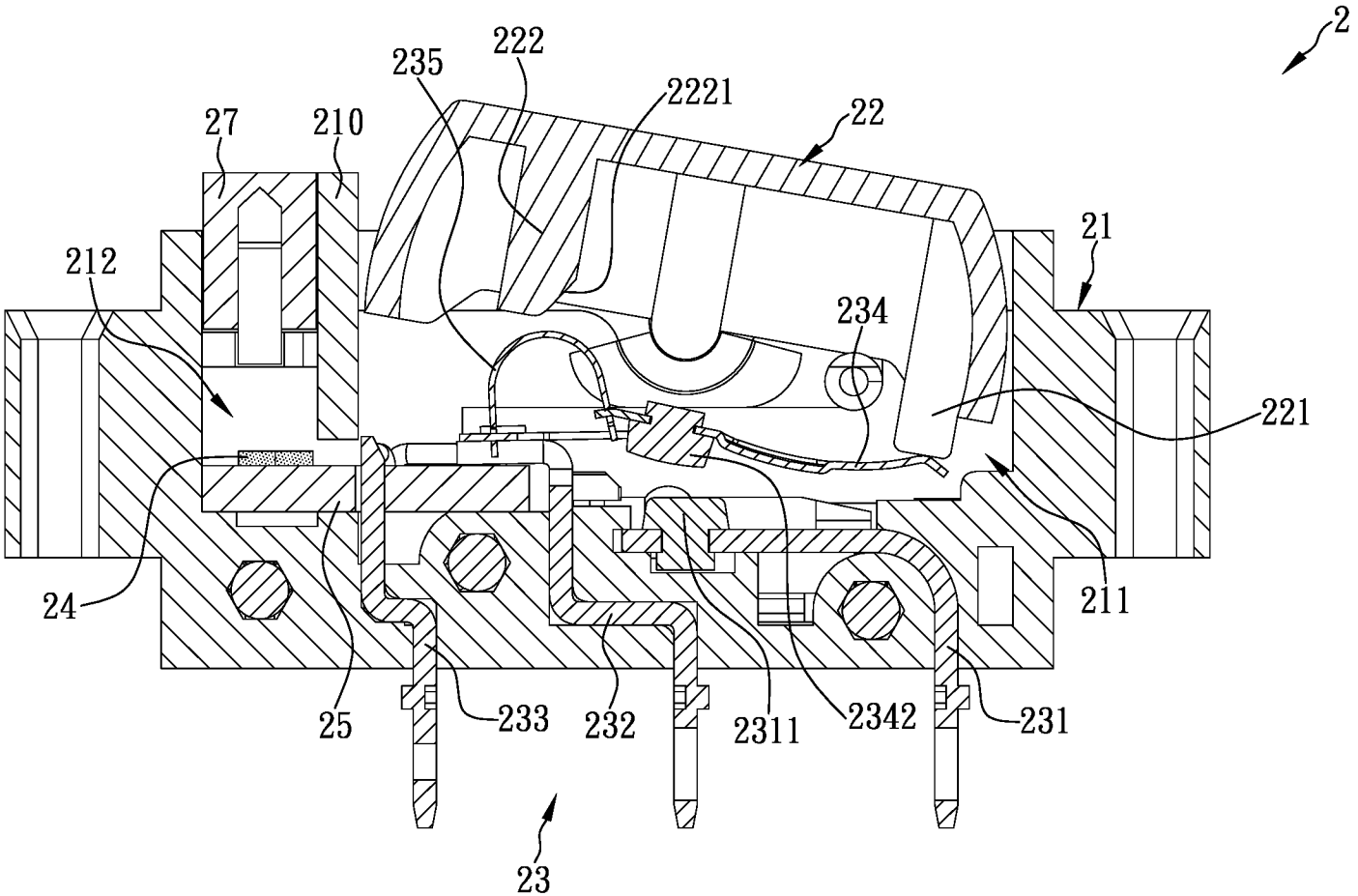
FIG. 4 is a sectional view of the power switch according to certain embodiments of the present disclosure being in the power-off state.

The present disclosure provides a power switch having an independent light-emitting chamber. Referring to FIG. 2 to FIG. 4, in certain embodiments, the power switch 2 includes a housing 21, a press-key 22, a power assembly 23, at least one light-emitting unit 24, and a circuit board 25. The housing 21 is provided therein with a partition wall 210 that divides the interior of the housing 21 into a first receiving space 211 and a second receiving space 212. The top side of the housing 21 is provided with a first opening 213 corresponding to the first receiving space 211. The top side of the housing 21 is also provided with a second opening 214 corresponding to the second receiving space 212. In certain embodiments, the partition wall 210 is integrally formed with the housing 21. However, in certain embodiments, the partition wall 210 may be an independent component that is independent from the housing 21 and can be mounted in the housing 21.

Referring again to FIG. 2 to FIG. 4, a middle portion of the press-key 22 can be pivotally connected to the inner edge of the first opening 213 or a position at the first opening 213 that is adjacent to the inner edge of the first opening 213. Referring to FIG. 3, the two opposite outer sides of the middle portion of the press-key 22 are each protrudingly provided with a pivotal connection block 220, and each pivotal connection block 220 is configured to be mounted in a pivotal connection groove 215 in the housing 21 so that the press-key 22 can be rotated counterclockwise as well as clockwise about the pivotal connection blocks 220 as an axis for the press-key 22. A first pushing portion 221 is protrudingly provided at a position on the press-key 22 that is adjacent to one end of the bottom side of the press-key 22. A second pushing portion 222 is protrudingly provided at a position on the press-key 22 that is adjacent to the other end of the bottom side of the press-key 22. Both the first pushing portion 221 and the second pushing portion 222 are configured to extend into the first receiving space 211. In certain embodiments, the first pushing portion 221 and/or the second pushing portion 222 may be integrally formed with the press-key 22. However, the present disclosure is not limited thereto. In certain embodiments, the first pushing portion 221 and/or the second pushing portion 222 may be an independent component that can be mounted on the press-key 22.

Figure 5:
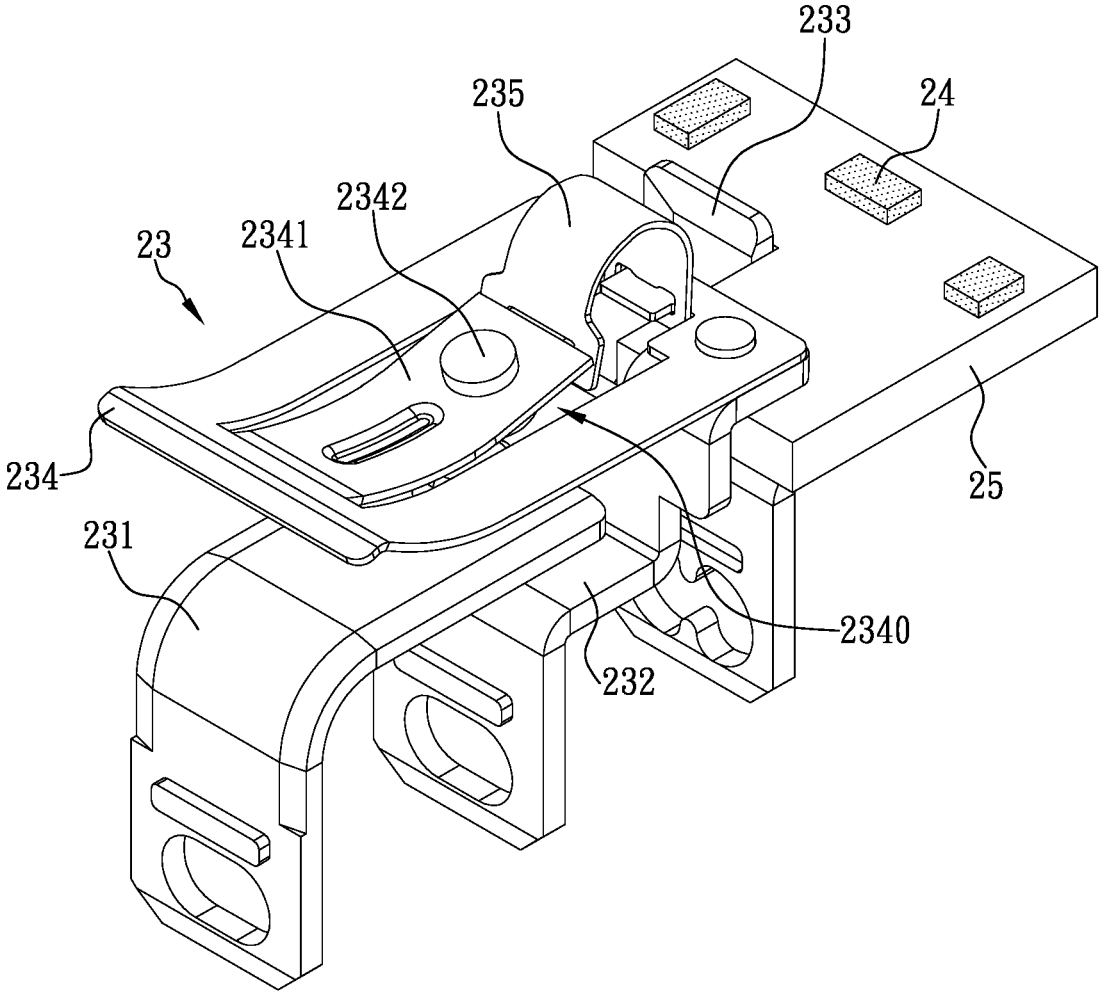
FIG. 5 is a perspective view of the power assembly, the light-emitting unit, and the circuit board according to certain embodiments of the present disclosure.

Referring to FIG. 4 and FIG. 5, the power assembly 23 can he disposed in the first receiving space 211. In certain embodiments, the power assembly 23 includes a first electrically conductive plate 231, a second electrically conductive plate 232, a heat-actuated metal plate 234, and a metal spring plate 235. The first electrically conductive plate 231 can be fixedly disposed at a position at the housing 21 that is adjacent to one end of the housing 21. The top end of the first electrically conductive plate 231 is provided with a first contact point 2311 that can be disposed in the first receiving space 211. The bottom end of the first electrically conductive plate 231 can extend out of the bottom side of the housing 21. The second electrically conductive plate 232 is fixedly disposed at a position at the housing 21 that is adjacent to the other end of the housing 21, and is electrically connected to the circuit board 25. The bottom end of the second electrically conductive plate 232 can extend out of the housing 21. It is noted that the terms of "adjacent to one end" and "adjacent to the other end" refer to the relative positions of the first electrically conductive plate 231 and the second electrically conductive plate 232, for example, in FIG. 4, the second electrically conductive plate 232 is closer to the other end of the housing 21 than is the first electrically conductive plate 231.

Referring again to FIG. 4 and FIG. 5, the heat-actuated metal plate 234 has one end corresponding to the first pushing portion 221, that is, the first pushing portion 221 can press at the one end of the heat-actuated metal plate 234 when the press-key 22 is pressed and displaces the first pushing portion 221 downward. The other end of the heat-actuated metal plate 234 can be connected to the top end of the second electrically conductive plate 232. The heat-actuated metal plate 234 is formed with a U-shaped or substantially U-shaped through hole 2340. An elastic plate 2341 is provided at an inner edge of the through hole 2340 that is opposite to the second electrically conductive plate 232. A free end of the elastic plate 2341 extends along a direction toward the second electrically conductive plate 232 and can he displaced above or below the through hole 2340 when subjected to a force. The free end of the elastic plate 2341 is provided with a second contact point 2342.

Figure 6:
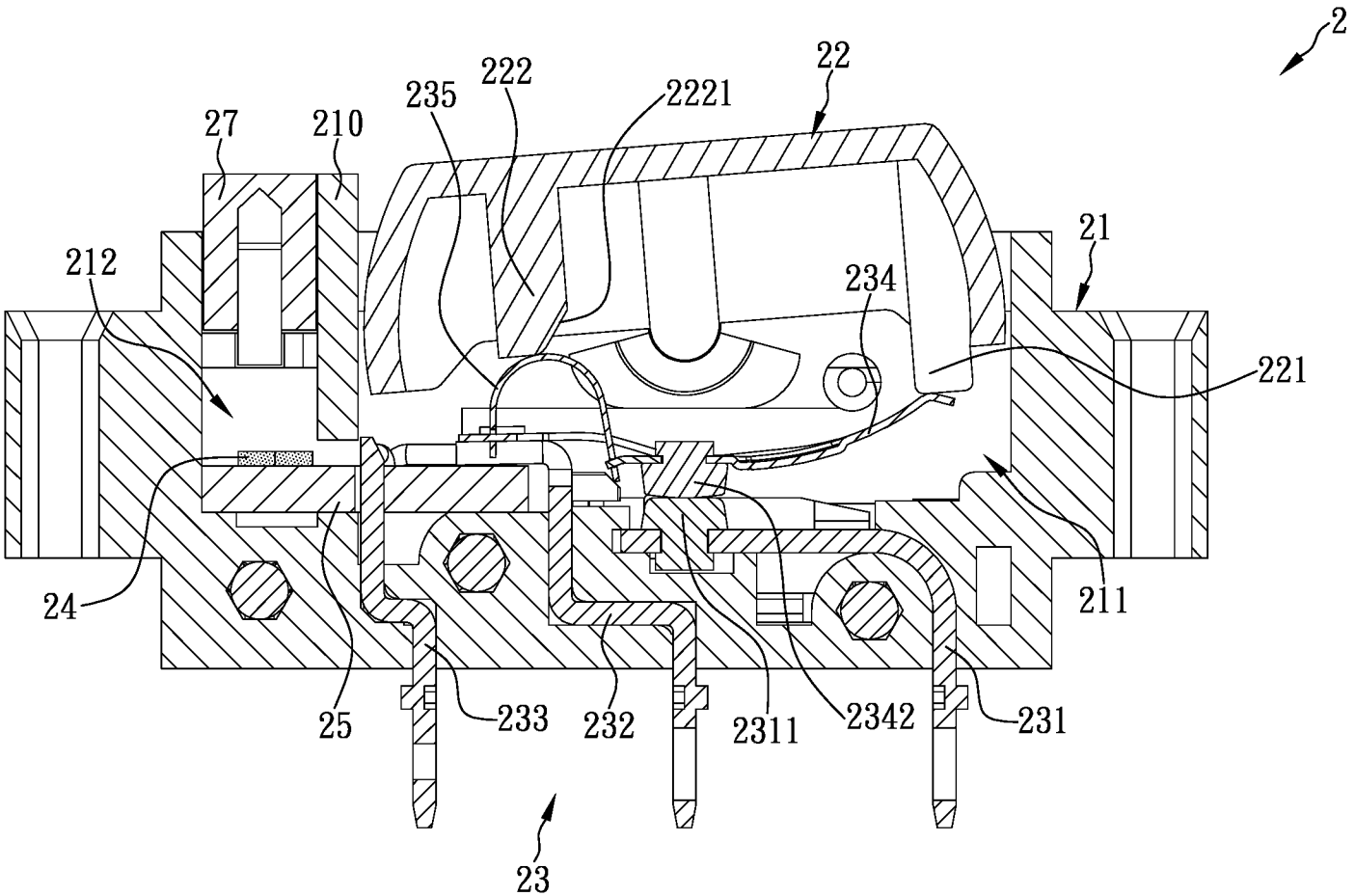
FIG. 6 is a sectional view of the power switch according to certain embodiments of the present disclosure being in the power-on state.

Referring again to FIG. 4 and FIG. 5, the metal spring plate 235 is C-shaped or substantially C-shaped, and has one end configured to be coupled to the free end of the elastic plate 2341 and the other end configured to be coupled to a portion of the heat-actuated metal plate 234 that is adjacent to the second electrically conductive plate 232. The metal spring plate 235 corresponds in position to the second pushing portion 222, that is, the second pushing portion 222 can press on the metal spring plate 235 when the press-key 22 is pressed and displaces the second pushing portion 222 downward. Therefore, when a user presses at one end of the press-key 22 and thereby moves the first pushing portion 221 downward, causing the first pushing portion 221 to press at the one end of the heat-actuated metal plate 234, the one end of the heat-actuated metal plate 234 will be moved downward and thus displace the free end of the elastic plate 2341 above the through hole 2340 such that the second contact point 2342 is separated from the first contact point 2311 (see FIG. 4) and the power switch 2 is brought into the power-off state. When the user presses at the other end of the press-key 22 and thereby moves the second pushing portion 222 downward, causing the second pushing portion 222 to press at the metal spring plate 235, the metal spring plate 235 deforms under the pressure such that the one end of the metal spring plate 235 drives the free end of the elastic plate 2341 downward below the through hole 2340. As a result, the second contact point 2342 is electrically connected to the first contact point 2311 (see FIG. 6) to bring the power switch 2 into the power-on state. However, the present disclosure is not limited thereto. In certain embodiments, the power assembly 23 is not limited to the structure described above, and as long as a power assembly has a first contact point and a second contact point, the first and the second contact points can be separated from each other by downward displacement of a first pushing portion to bring a power switch into a power-off state, and the first and the second contact points can be electrically connected with each other by downward displacement of a second pushing portion to bring the power switch into a power-on state, such a power assembly falls within the scope of the present disclosure.

Referring again to FIG. 4 and FIG. 5, in certain embodiments, the heat-actuated metal plate 234 can generate a restoring force due to a temperature-induced shape memory effect and thereby return to its pre-deformed state (e.g., to the configuration shown in FIG. 4), which improves safety of use. When the heat-actuated metal plate 234 is overloaded with electric current and having a temperature exceeding its shape memory-inducing temperature, the heat-actuated metal plate 234 is deformed in an opposite direction by the restoring force of itself and of the elastic plate 2341, forcing the metal spring plate 235 to push the second pushing portion 222 upward. In the meantime, the free end of the elastic plate 2341 moves to be above the through hole 2340 to separate the second contact point 2342 from the first contact point 2311, thereby bringing the power switch 2 into the power-off state. Moreover, if the other end of the press-key 22 is inadvertently held down by an external object and cannot be moved upward, the free end of the elastic plate 2341 can still move through and above the through hole 2340 by the restoring force of the elastic plate 2341 itself to separate the second contact point 2342 from the first contact point 2311. Moreover, to facilitate the foregoing process, a bottom portion of the second pushing portion 222 is provided with an inclined surface 2221 so that when the free end of the elastic plate 2341 is displaced upward, a portion of the metal spring plate 235 can be deformed and moved along the inclined surface 2221 to make upward movement of the free end of the elastic plate 2341 much easier, so as to cut off power supply automatically when an overcurrent takes place, and to protect the electrical appliance connected to the power switch 2 from being damaged.

Referring again to FIG. 2 to FIG. 4, the at least one light-emitting unit 24 can be disposed in the second receiving space 212 such that the second receiving space 212 forms an independent light-emitting chamber. The partition wall 210 keeps the light-emitting unit 24 from contact with the power assembly 23, so short-circuiting between the light-emitting unit 24 and the power assembly 23 can be prevented. Also, no extra effort is required to adjust the wires (or electrode leads) of the light-emitting unit 24 as is required for a conventional power switch. In certain embodiments, the light-emitting unit 24 is a light-emitting diode (LED) and is disposed at a bottom portion of the second receiving space 212, so that in terms of manufacture the light-emitting unit 24 can be mounted on the circuit board 25 in advance. The exposed wires of the light-emitting unit 24 can be effectively blocked by the partition wall 210 so that the light-emitting unit 24 is not affected when the power switch 2 is shaken by an external force or when the press-key 22 is pressed multiple times and therefore in a back-and-forth movement. Accordingly, the safety of use of the power switch 2 is effectively enhanced in comparison with that of a conventional power switch.

Referring again to FIG. 2 to FIG. 4, the circuit board 25 can be disposed in the housing 21 and electrically connected to the power assembly 23 and the light-emitting unit 24. In certain embodiments, the partition wall 210 is spaced apart from the inner bottom surface of the housing 21 with a gap, and the housing 21 is assembled from two components so that the circuit board 25 can be inserted into the gap from a lateral side and then fixed to the housing 21. However, the present disclosure is not limited thereto. In certain embodiments where the partition wall 210 is an independent component, the circuit board 25 can be placed downward into the housing 21, before the partition wall 210 is mounted to (e.g., engaged with, adhesively bonded to, or high-frequency welded to) the housing 21. In addition, a top end of a third electrically conductive plate 233 can be electrically connected to the circuit board 25 and the light-emitting unit 24, and a bottom end of the third electrically conductive plate 233 can extend out of the housing 21, so that when the power switch 2 is in the power-on state, the circuit board 25 transmits electricity from the power assembly 23 to the light-emitting unit 24 so that the light-emitting unit 24 emits light. Further, the power switch 2 can be provided with a light-permeable cover 27 to protect the light-emitting unit 24. The light-permeable cover 27 can be mounted on the housing 21 at a position corresponding to the second opening 214 such that the light of the light-emitting unit 24 can he seen through the light-permeable cover 27.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A power switch, comprising:

a housing provided therein with a partition wall that divides an interior of the housing into a first receiving space and a second receiving space that is an independent light-emitting chamber, wherein a top side of the housing is provided with a first opening corresponding to the first receiving space and a second opening corresponding to the second receiving space;

a press-key having a middle portion configured to be pivotally connected to an inner edge of the first opening or a position at the first opening that is adjacent to the inner edge of the first opening, wherein a first pushing portion is protrudingly provided at a position on the press-key that is adjacent to one end of a bottom side of the press-key, and a second pushing portion is protrudingly provided at a position on the press-key that is adjacent to the other end of the bottom side of the press-key;

a power assembly disposed in the first receiving space, having a first contact point and a second contact point, and configured to:

separate the second contact point from the first contact point when the first pushing portion moves downwards; and electrically connect the second contact point with the first contact point when the second pushing portion moves downwards;

at least one light-emitting unit disposed in the second receiving space; and a circuit board disposed in the housing and electrically connected to the power assembly and the light-emitting unit, wherein a bottom end of the partition wall is higher than a top surface of the light-emitting unit.

2. The power switch according to claim 1, further comprising a light-permeable cover configured to be mounted on the housing at a position corresponding to the second opening.

3. The power switch according to claim 1, wherein the light-emitting unit is a light-emitting diode.

4. The power switch according to claim 1, wherein the partition wall is integrally formed with the housing.

5. The power switch according to claim 1, wherein the partition wall is independent from the housing and configured to be extended into and mounted in the housing.

6. The power switch according to claim 1, wherein the power assembly comprises:

a first electrically conductive plate fixedly disposed at a position at the housing that is adjacent to one end of the housing, and having a top end provided with a first contact point and configured to be disposed in the first receiving space and a bottom end configured to extend out of a bottom side of the housing;

a second electrically conductive plate fixedly disposed at a position at the housing that is adjacent to the other end of the housing, electrically connected to the circuit board, and having a top end configured to be disposed in the first receiving space and a bottom end configured to extend out of th.e bottom side of the housing;

a heat-actuated metal plate having one end corresponding to the first pushing portion and configured to be pressed by the first pushing portion when one end of the press-key is pressed and the other end configured to be connected to the top end of the second electrically conductive plate, and formed with a through hole, wherein an elastic plate is provided at an inner edge of the through hole that is opposite to the second electrically conductive plate, and has a free end being provided with a second contact point, extending along a direction toward the second electrically conductive plate, and configured to be displaced above the through hole to separate the second contact point from the first contact point when the first pushing portion presses the one end of the heat-actuated metal plate, and to be displaced below the through hole to electrically connect the second contact point with the first contact point; and a metal spring plate corresponding in position to the second pushing portion, having one end configured to be coupled to the free end of the elastic plate and the other end configured to be coupled to a portion of the heat-actuated metal plate that is adjacent to the second electrically conductive plate, and configured to be pressed by the second pushing portion to displace the free end of the elastic plate below the through hole when the other end of the press-key is pressed.

7. The power switch according to claim 6, further comprising a third electrically conductive plate having a top end configured to be electrically connected to the circuit board and a bottom end configured to extend out of the housing.

8. The power switch according to claim 6, wherein the heat-actuated metal plate is configured to generate a restoring force and force the metal spring plate to push the second pushing portion so that the free end of the elastic plate is displaced to be above the through hole to separate the second contact point from the first contact point when the heat-actuated metal plate is overloaded with electric current and having a temperature exceeding a shape memory-inducing temperature of the heat-actuated metal plate.

9. The power switch according to claim 8, wherein a bottom portion of the second pushing portion is provided with an inclined surface, and the metal spring plate is configured to deform and move along the inclined surface by being driven by a restoring force of the elastic plate when the heat-actuated metal plate has a temperature exceeding the shape memory-inducing temperature of the heat-actuated metal plate and the press-key is held down by an external object and cannot be moved, so that the free end of the elastic plate is displaced to be above the through hole to separate the second contact point from the first contact point.

* * * * *